United States Patent [19]

Antonacci et al.

[11] Patent Number: 5,073,436

[45] Date of Patent: Dec. 17, 1991

[54] MULTI-LAYER COMPOSITE NONWOVEN FABRICS

[75] Inventors: Paul N. Antonacci, Smyrna; Geraldine M. Eaton, Acworth; Delores R. Morris, Powder Springs; William T. Tapp, Marietta, all of Ga.

[73] Assignee: Amoco Corporation, Chicago, Ill.

[21] Appl. No.: 556,354

[22] Filed: Jul. 20, 1990

Related U.S. Application Data

[63] Continuation-in-part of Ser. No. 464,249, Jan. 12, 1990, abandoned, and Ser. No. 411,908, Sep. 25, 1989.

[51] Int. Cl.[5] ..... B32B 5/06

[52] U.S. Cl. ..... 428/219; 428/284; 428/286; 428/296; 428/297; 428/298; 428/903; 428/913

[58] Field of Search ..... 428/219, 284, 286, 297, 428/298, 903, 913, 296

[56] References Cited

U.S. PATENT DOCUMENTS

| | | | |
|---|---|---|---|
| 3,849,241 | 11/1974 | Butin et al. | 161/169 |
| 4,041,203 | 8/1977 | Brock et al. | 428/157 |
| 4,196,245 | 4/1980 | Kitson et al. | 428/198 |
| 4,340,563 | 7/1982 | Appel et al. | 264/518 |
| 4,436,780 | 3/1984 | Hotchkiss et al. | 428/198 |
| 4,443,513 | 4/1984 | Meitner et al. | 422/195 |
| 4,659,609 | 4/1987 | Lamers et al. | 428/194 |
| 4,741,944 | 5/1988 | Jackson et al. | 428/403 |
| 4,766,029 | 8/1988 | Brock et al. | 428/286 |
| 4,863,785 | 9/1989 | Berman et al. | 428/218 |
| 4,906,513 | 3/1990 | Hebbelt et al. | 428/903 |
| 4,931,355 | 6/1990 | Radwanski et al. | 428/903 |
| 4,939,016 | 7/1990 | Radwanski et al. | 428/903 |

*Primary Examiner*—James J. Bell

*Attorney, Agent, or Firm*—Robert G. Ladd; William H. Magidson; Ralph C. Medhurst

[57] ABSTRACT

A multi-layer composite of nonwoven fabrics comprising at least one layer of a self-bonded, fibrous, web nonwoven bonded to at least one layer of a microfibrous, nonwoven web having water repellency and water vapor permeability properties particularly suitable for protective apparel applications.

21 Claims, 2 Drawing Sheets

MULTI-LAYER COMPOSITE NONWOVEN FABRICS

CROSS-REFERENCE TO RELATED APPLICATIONS

This application is a continuation-in-part application of U.S. Ser. No. 464,249 filed Jan. 12, 1990 now abandoned and U.S. Ser. No. 411,908 filed Sept. 25, 1989.

FIELD OF INVENTION

This invention relates to a multi-layer composite nonwoven fabric comprising at least one layer of a self-bonded, fibrous, nonwoven web having a very uniform basis weight of about 0.1 oz/yd$^2$ or greater comprising substantially randomly disposed, substantially continuous thermoplastic filaments bonded to at least one layer of a microfibrous, nonwoven web comprising discontinuous filaments.

BACKGROUND OF THE INVENTION

Composites of nonwoven webs are well known for a wide variety of end uses such as wipes, surgical drapes, surgical gowns and protective apparel applications.

Prior art multi-layer composites of nonwoven webs having water repellency and water vapor permeability properties have been formed from various combinations of nonwoven web layers. One such combination is material in which mats of microfibers, preferably meltblown nonwoven webs, are laminated to one or more webs of continuous filaments, preferably spunbond filaments.

Meltblown polymeric nonwoven webs are produced by heating a polymer resin to form a melt, extruding the melt through a die orifice in a die head, directing a fluid stream, typically air, toward the polymer melt exiting the die orifice to form filaments or fibers that are discontinuous and attenuated, and depositing the fibers onto a collection surface. Bonding of the web to achieve integrity and strength occurs as a separate downstream operation. Such a meltblown process is disclosed in U.S. Pat. No. 3,849,241. Meltblown webs are characterized by their softness, bulk absorbency, and water repellency properties. The filaments of such webs are generally discontinuous and of relatively low diameter.

Spunbond polymeric nonwoven webs can be produced by extruding a multiplicity of continuous thermoplastic polymer strands through a die in a downward direction onto a moving surface where the extruded strands are collected in randomly distributed fashion. The randomly distributed strands are subsequently bonded together by thermobonding or by needlepunching to provide sufficient integrity in a resulting nonwoven web of continuous fibers. One method of producing spunbond nonwoven webs is disclosed in U.S. Pat. No. 4,340,563. Spunbond webs are characterized by a relatively high strength/weight ratio, isotropic strength, high porosity and abrasion resistance properties. Spunbond nonwoven webs are non-uniform in properties such as basis weight. The filaments of those webs are generally substantially continuous and of greater diameter than those of meltblown webs.

A major limitation of many commercially available multi-layer composite laminates of spunbond/meltblown/spunbond (SMS) nonwoven webs is that the spunbond webs are nonuniform in coverage and basis weight. In many applications, attempts are made to compensate for poor fabric aesthetics and limiting physical properties that result from this nonuniformity of coverage and basis weight by using webs having a greater number of filaments and a heavier basis weight than would normally be required by the particular application if the web had a more uniform coverage and basis weight. This, of course, adds to the cost of the composite product and contributes to greater stiffness and other undesirable features.

In view of the limitations of the spunbond nonwoven webs in multi-layer composites, there is a need for improved composite nonwovens and, particularly, those wherein a self-bonded, fibrous nonwoven web material having very uniform basis weight and balanced physical properties is used as least one layer bonded to at least one layer of a microfibrous, nonwoven web to form a multi-layer polymeric nonwoven web composite.

U.S. Pat. No. 4,196,245 discloses laminates of spunbond and melt-blown nonwoven fabrics having liquid strike-through resistance and air permeability.

U.S. Pat. No. 4,041,203 discloses laminates of spunbond and meltblown nonwovens in which the meltblown nonwoven has a softening temperature of about 10° to 40° C. less than the softening temperature of the spunbond nonwoven. The laminates are suggested for applications such as outer wear linings, jackets, rainwear, pillowcases, sleeping and slumber bags and liners.

U.S. Pat. No. 4,374,888 discloses a three-layer laminate having a basis weight of 2.5 to 10 oz/yd$^2$ in which the outer layes are spunbond nonwovens and the intermediate layer is a melt-blown nonwoven. The outer layers are treated for resistance to ultraviolet radiation degradation and flame retardance.

U.S. Pat. No. 4,436,780 discloses laminates of a meltblown thermoplastic microfiber web having a basis weight in the range of about 17 to 170 g/m$^2$ having an average diameter in the range of up to about 10 microns and treated with a surfactant and, on both sides of the meltblown web, a relatively low basis weight web having a basis weight in the range of about 7 to 34 g/m$^2$ comprising generally continuous thermoplastic filaments having an average diameter in excess of about 10 microns wherein the weight ratio of the meltblown web to the combined outer webs is at least about 2 to 1.

U.S. Pat. No. 4,766,029 discloses a three-layer, semipermeable, nonwoven laminate in which the two exterior layers are spunbond polypropylene having a melt flow of 35 g/10 min and the interior layer is a two-component meltblown layer of polyethylene and polypropylene with the laminate calendered after formation.

U.S. Pat. No. 4,443,513 discloses soft nonwoven webs of entangled fibers or filaments having a pattern of fused bond areas and a stretched, loopy filament configuration outside the patterned bond area including laminates comprising at least one spunbond layer and at least one microfiber layer having an average diameter of less than 10 microns.

U.S. Pat. No. 4,659,609 discloses a layered abrasive web comprising a meltblown layer having a basis weight of about 5 to about 25 g/m$^2$ and average fiber diameters of at least about 40 micrometers and a spunbond layer thermally bonded to the meltblown layer.

U.S. Pat. No. 4,863,785 discloses a nonwoven composite material with a melt-blown fabric layer sandwiched between two prebonded, spunbonded reinforcing layers, all continuously-bonded together. The spunbonded material requires prebonding and no parameters or methods of measurement for uniform basis weight are identified.

These patents do not disclose the invented composite nonwoven products comprising at least one layer of a meltblown, discontinuous microfiber web and at least one layer of a substantially randomly disposed, substantially continuous thermoplastic filament web having a high degree of basis weight uniformity, nor do they disclose the improved water repellency and retained water vapor permeability and breathability properties of such composites.

As used herein, a nonwoven web having uniform basis weight is taken to mean a nonwoven web which has a Basis Weight Uniformity Index (BWUI) of 1.0±0.05, wherein the BWUI is defined as a ratio of an average unit area basis weight determined on a unit area sample of the web to an average area basis weight determined on an area sample, N times as large as the unit area sample, wherein N is about 12 to about 18, the unit area sample has an area of 1 $in^2$, and wherein standard deviations of the average unit area basis weight and the average area basis weight are less than 10% and the number of samples is sufficient to obtain average basis weights at a 0.95 confidence interval. For example, for a nonwoven web in which 60 samples of 1 $in^2$ squares determined to have an average basis weight of 0.993667 $oz/yd^2$ and a standard deviation (SD) of 0.0671443 (SD of 6.76% of the average) and 60 samples of 16 $in^2$ squares (N was 16) determined to have an average basis weight of 0.968667 $oz/yd^2$ and a standard deviation of 0.0493849 (SD of 5.10% of average), the calculated BWUI was 1.026.

It is an object of the present invention to provide a multi-layer composite nonwoven fabrics comprising at least one layer of a self-bonded, fibrous nonwoven web bonded to at least one layer of a microfibrous, nonwoven web.

Another object of the present invention is to provide a multi-layer composite having a basis weight in the range of about 0.5 to about 5.0 $oz/yd^2$ comprising at least one layer of a self-bonded web having a plurality of substantially randomly disposed, substantially continuous thermoplastic filaments having a basis weight in the range of about 0.1 to about 3.0 $oz/yd^2$ with a BWUI of 1.0±0.05 and at least one layer of a microfibrous web comprising a plurality of substantially totally discontinuous thermoplastic filaments having a basis weight in the range of about 0.1 to about 2.0 $oz/yd^2$.

A further object of the present invention is to provide a multi-layer composite nonwoven web having water repellency and air and water vapor permeability properties comprising at least one layer of a self-bonded, fibrous nonwoven web and at least one layer of a microfibrous web wherein the self-bonded webs and the microfibrous webs are each produced from thermoplastic selected from the group consisting of polypropylene, high density polyethylene, low density polyethylene, linear low density polyethylene, a blend of polypropylene and polybutene and a blend of linear low density polyethylene and polypropylene.

Among the advantages produced by the multi-layered composites of the present invention are improved water repellency and water vapor permeability properties for a given total basis weight. This improvement is achieved due to the very uniform basis weight properties of the self-bonded, fibrous nonwoven webs comprising substantially randomly disposed, substantially continuous polymeric filaments which enable lower basis weight self-bonded webs to be used to provide strength to the composites. Additionally, the use of blends of polypropylene with polybutene and/or linear low density polyethylene provides the multi-layer compounds with a better hand and improved softness.

SUMMARY OF THE INVENTION

The objects of this invention are provided in a multi-layered composite nonwoven fabric having a basis weight in the range of about 0.5 to about 5.0 $oz/yd^2$ with water repellency and water vapor permeability properties comprising at least one layer of a self-bonded web having a plurality of substantially randomly disposed, substantially continuous thermoplastic filaments having a uniform basis weight in the range of about 0.1 to about 3.0 oz/yd2 with a BWUI of 1.0±0.05 bonded to at least one layer of a microfibrous, nonwoven web having a basis weight in the range of about 0.1 to about 2.0 $oz/yd^2$.

In one aspect, the invention provides a multi-layer composite nonwoven web comprising at least one layer of a self-bonded, fibrous nonwoven web bonded to at least one layer of a microfibrous, nonwoven web.

In another aspect, the invention provides a multi-layer composite having a basis weight in the range of about 0.5 to about 5.0 $oz/yd^2$ comprising at least one layer of a self-bonded web having a plurality of substantially randomly disposed, substantially continuous thermoplastic filaments having a basis weight in the range of about 0.1 to about 3.0 $oz/yd^2$ and at least one layer of a microfibrous web comprising a plurality of substantially totally discontinuous thermoplastic filaments having a basis weight in the range of about 0.1 to about 2.0 $oz/yd^2$.

In a further aspect, the invention provides a multi-layer composite of nonwoven webs having water repellency and water vapor permeability properties comprising at least one layer of a self-bonded, fibrous nonwoven web and at least one layer of a microfibrous web wherein the self-bonded webs and the microfiberous webs are each produced from thermoplastics selected from the group consisting of polypropylene, high density polyethylene, low density polyethylene, linear low density polyethylene, a blend of polypropylene and polybutene and a blend of linear low density polyethylene and polypropylene.

DETAILED DESCRIPTION OF THE INVENTION

Figure 1:
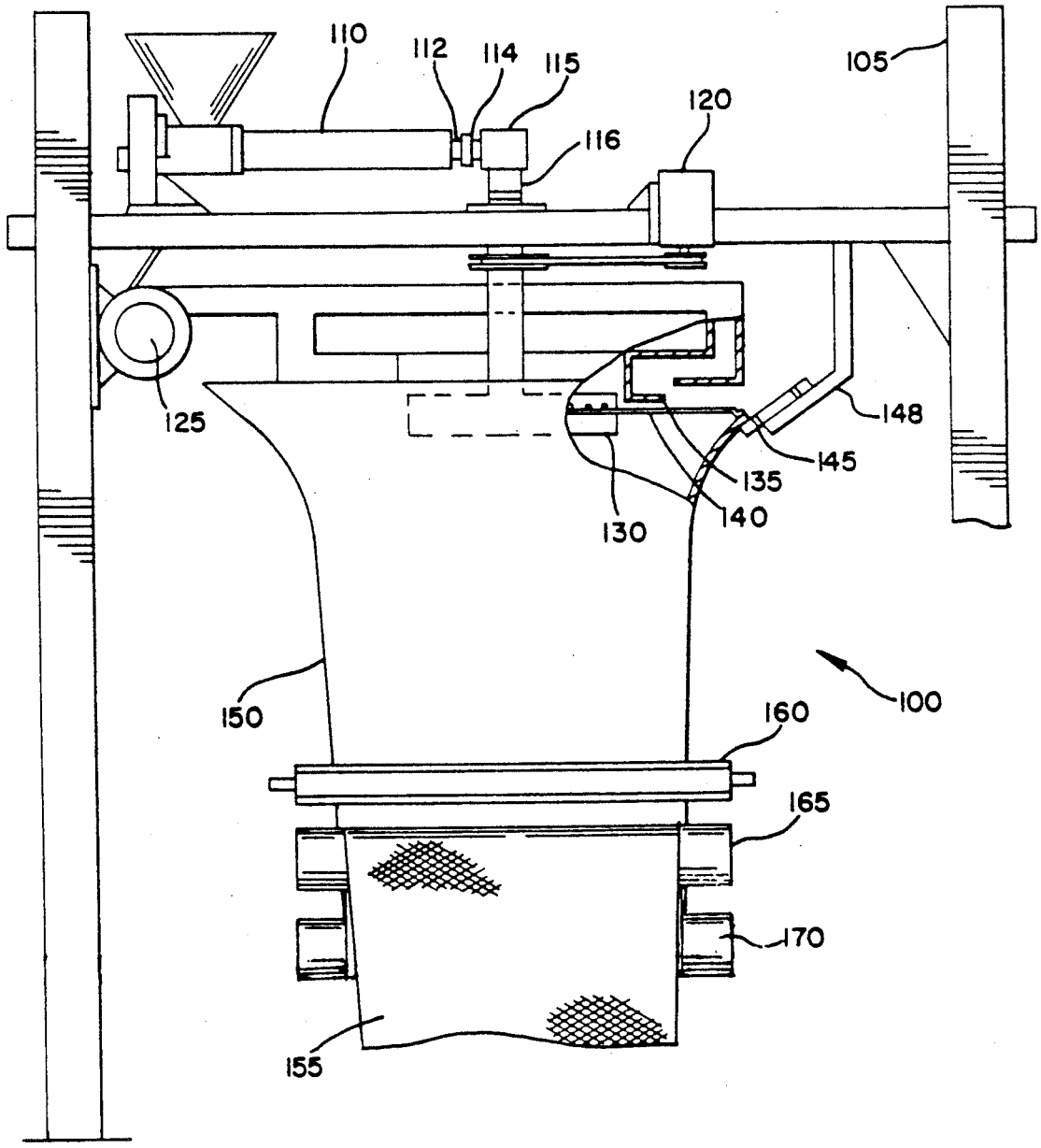
FIG. 1 is a schematic illustration of the system used to produce the self-bonded, fibrous, nonwoven web used in at least one layer of the multi-layer composite nonwoven fabric of the present invention.

The multi-layer polymeric composite of the present invention is a nonwoven web comprising at least one layer of a uniform basis weight self-bonded, fibrous nonwoven web bonded to at least one layer of a microfibrous, nonwoven web.

By "nonwoven web" it is meant a web of material which has been formed without the use of weaving processes and which has a construction of individual fibers, filaments or threads which are substantially randomly dispersed.

By "uniform basis weight nonwoven web" it is meant a nonwoven web comprising a plurality of substantially randomly disposed, substantially continuous polymeric filaments having a basis weight of about 0.1 oz/yd$^2$ or greater with filament deniers in the range of about 0.5 to about 20, for polypropylene this filament denier range corresponds to filament diameters of about 5 to about 220 microns, and a BWUI of 1.0±0.05. BWUI is defined as a ratio of an average unit area basis weight determined on a unit area sample of web to an average basis weight determined on an area of web, N times as large as the unit area, wherein N is about 12 to about 18, the unit area is 1 in$^2$ and wherein standard deviations of the average unit area basis weight and the average basis weight are less than 10% and the number of samples is sufficient to obtain basis weights at a 0.95 confidence interval. As used herein for the determination of BWUI, both the average unit area basis weight and the average area basis weight must have standard deviations of less than 10% where "average" and "standard deviation" have the definitions generally ascribed to them by the science of statistics. Materials having BWUI's of 1.0±0.05 which are determined from average basis weights having standard deviations greater than 10% for one or both of the averages do not represent a uniform basis weight nonwoven web as defined herein and are poorly suited for use in making the invented coated self-bonded nonwoven web composites because the nonuniformity of basis weights may require heavier basis weight materials to be used to obtain the desired coverage and fabric aesthetics. Unit area samples below about 1 in$^2$ in area for webs which have particularly nonuniform basis weight and coverage would represent areas too small to give a meaningful interpretation of the unit area basis weight of the web. The samples on which the basis weights are determined can be any convenient shape, such as square, circular, diamond and the like, with the samples randomly cut from the fabric by punch dies, scissors and the like to assure uniformity of the sample area size. The larger area is about 12 to about 18 times the area of the unit area. The larger area is required to obtain an average basis weight for the web which will tend to "average out" the thick and thin areas of the web. The BWUI is then calculated by determining the ratio of the average unit area basis weight to the average larger area basis weight. A BWUI of 1.0 indicates a web with a very uniform basis weight. Materials having BWUI values of less than 0.95 or more than 1.05 are not considered to have uniform basis weights as defined herein. Preferably, the BWUI has a value of 1.0±0.03.

By "self-bonded" it is meant that the crystalline and oriented filaments or fibers in the nonwoven web adhere to each other at their contact points thereby forming a self-bonded, fibrous, nonwoven web. Adhesion of the fibers may be due to fusion of the hot fibers as they contact each other, to entanglement of the fibers with each other or to a combination of fusion and entanglement. Of course, bonding does not occur at all contact points. Generally, however, the bonding of the fibers is such that the nonwoven web after being laid down but before further treatment has sufficient machine direction (MD) and cross-machine direction (CD) tensile strength to allow handling of the web without additional treatment. No foreign material need be present to promote bonding and essentially no polymer flows to the intersection points as distinguished from that which occurs during the process of heat-bonding thermoplastic filaments. The bonds are weaker than the filaments as evidenced by the observation that an exertion of a force tending to disrupt the web, as in tufting, will fracture bonds before breaking filaments. Of course, the self-bonded web can be prebonded, e.g. by a calendering operation or with adhesive, if desired, but prebonding is not always required due to the integrity of the self-bonded web as produced.

By "substantially continuous," in reference to polymeric filaments of the self-bonded webs, it is meant that a majority of the filaments or fibers formed are as substantially continuous nonbroken fibers as they are drawn and formed into the self-bonded web.

The microfibrous, nonwoven web used in the multilayer composite of the present invention can have a basis weight in the range of 0.1 to about 2.0 oz/yd$^2$ and can be a meltblown microfibrous nonwoven web comprising a plurality of substantially totally discontinuous thermoplastic filaments of small diameter fibers having an average filament diameter not greater than about 10 microns, preferably in the range of about 1 to about 5 microns.

The self-bonded, fibrous nonwoven web of substantially randomly disposed, substantially continuous polymeric filaments used in the multi-layer composites of the present invention can be formed by the apparatus disclosed in U.S. Pat. No. 4,790,736, incorporated herein by reference. In a preferred embodiment, the self-bonded webs are prepared by:

(a) extruding a molten polymer through multiple orifices located in a rotating die,
(b) contacting said extruded polymer while hot as it exits said orifices with a fluid stream to form substantially continuous filaments and to draw said filaments into fibers having deniers in the range of about 0.5 to about 20, and
(c) collecting said drawn fibers on a collection device whereby the filaments extruded through the die strike the collection device and self-bond to each other to form the nonwoven web.

A source of liquid fiber forming material such as a thermoplastic melt is provided and pumped into a rotating die having a plurality of spinnerets about its periphery. The rotating die is rotated at an adjustable speed such that the periphery of the die has a spinning speed of about 150 to about 2000 m/min. The spinning speed is calculated by multiplying the periphery circumference by the rotating die rotation speed measured in revolutions per minute.

The thermoplastic polymer melt is extruded through a plurality of spinnerets located about the circumference of the rotating die. There can be multiple spinning orifices per spinneret and the diameter of an individual spinning orifice can be be between about 0.1 to about 2.5 mm, preferably about 0.2 to about 1.0 mm. The length-to-diameter ratio of the spinneret orifice is about 1:1 to about 10:1. The particular geometrical configuration of the spinneret orifice can be circular, elliptical, trilobal or any other suitable configuration. Preferably, the configuration of spinneret orifice is circular or trilobal. The rate of polymer extruded through the spinneret orifices can be about 0.05 lb/hr/orifice or greater. Preferably, the rate is about 0.2 lb/hr/orifice or greater.

As the fibers extrude horizontally through spinneret orifices in the circumference of the rotating die, the fibers assume a helical orbit as they begin to fall below the rotating die. The fluid stream which contacts the fibers can be directed downward onto the fibers, can be directed to surround the fibers or can be directed essentially parallel to the extruded fibers. The fluid stream is typically ambient air which can also be conditioned by heating, cooling, humidifying or dehumidifying. A pressure air blower fan can be used to generate a quench air stream. Polymer fibers extruded through the spinneret orifices of the rotary die are contacted by the quench air stream.

The quench air stream can be directed radially above the fibers which are drawn toward the high velocity air stream as a result of a partial vacuum created in the area of the fiber by the air stream. The polymer fibers then enter the high velocity air stream and are drawn, quenched and transported to a collection surface. The high velocity air, accelerated and distributed in a radial manner contributes to the attenuation or drawing of the radially extruded thermoplastic melt fibers. The accelerated air velocities contribute to the placement or "laydown" of fibers onto a circular fiber collector surface or collector plate such that self-bonded, fibrous nonwoven webs are formed that exhibit improved properties including increased tensile strength, lower elongation and more balanced physical properties in the machine direction and cross-machine direction from filaments having deniers ranging from about 0.5 to about 20 as well as webs which have a very uniform basis weight with BWUI's of $1.0 \pm 0.05$.

The fibers are conveyed to the collector plate at elevated air speeds which promote entanglement of the fibers for web integrity. While the fibers are moving at a speed dependent upon the speed of rotation of the die as they are drawn down, by the time the fibers reach the outer diameter of the orbit, they are not moving circumferentially, but are merely being laid down in that particular orbit basically one on top of another. The particular orbit may change depending upon variation of rotational speed of the die, extrudate rate, temperature, etc. External forces such as electrostatic charge or air pressure can be used to alter the orbit and, therefore, deflect the fibers into different patterns.

The self-bonded, fibrous nonwoven webs are produced by allowing the extruded thermoplastic fibers to contact each other as the fibers are deposited on a collection surface. Many of the fibers, but not all, adhere to each other at their contact points thereby forming a self-bonded, fibrous nonwoven web. Adhesion of the fibers may be due to fusion of the hot fibers as they contact each other, to entanglement of the fibers with each other or to a combination of fusion and entanglement. Generally, the adhesion of the fibers is such that the nonwoven web after being laid down but before further treatment has sufficient MD and CD strength to allow handling of the web without additional treatment as generally required by spunbond nonwoven webs.

The self-bonded, fibrous nonwoven web conforms to the shape of the collection surface which can be of various shapes such as a cone-shaped inverted bucket, a moving screen or a flat surface in the shape of an annular strike plate located slightly below the elevation of the die and with the inner diameter of the annular strike plate being at an adjustable, lower elevation than the outer diameter of the strike plate.

When an annular strike plate is used as the collection surface, many of the fibers are bonded together during contact with each other and with the annular strike plate producing a nonwoven fabric which is drawn back through the aperture of the annular strike plate as a tubular fabric. A stationary spreader can be supported below the rotary die to spread the fabric into a flat, two-ply fabric which is collected by a pull roll and winder. In the alternative, a knife arrangement can be used to cut the tubular, two-ply fabric into a single-ply fabric which can be collected by a pull roll and winder.

Temperature of the thermoplastic melt affects the process stability for the particular thermoplastic used. The temperature must be sufficiently high so as to enable drawdown, but not too high so as to allow excessive thermal degradation of the thermoplastic.

Process parameters which control fiber formation from the thermoplastic polymers include: the spinneret orifice design, dimension and number; the extrusion rate of polymer through the orifices; the quench air velocity; and the rotational speed of the die.

The filament diameter can be influenced by all of the above parameters with filament diameter typically increasing with larger spinneret orifices, higher extrusion rates per orifice, lower air quench velocity and lower rotary die rotation with other parameters remaining constant.

Productivity is influenced by the dimension and number of spinneret orifices, the extrusion rate and for a given denier fiber the rotary die rotation.

In general, any suitable thermoplastic resin can be used in making the self-bonded, fibrous, nonwoven webs used to make the multi-layer composite nonwoven fabrics of the present invention. Suitable thermoplastic resins include polyolefins of branched and straight-chained olefins such as low density polyethylene, linear low density polyethylene, high density polyethylene, polypropylene, polybutene, polyamides, polyesters such as polyethylene terephthalate, combinations thereof and the like.

The term "polyolefins" is meant to include homopolymers, copolymers and blends of polymers prepared from at least 50 wt. % of an unsaturated hydrocarbon monomer. Examples of such polyolefins include polyethylene, polystyrene, polyvinyl chloride, polyvinyl acetate, polyvinylidene chloride, polyacrylic acid, polymethacrylic acid, polymethyl methacrylate, polyethyl acrylate, polyacrylamide, polyacrylonitrile, polypropylene, polybutene-1, polybutene-2, polypentene-1, polypentene-2, poly-3-methylpentene-1, poly-4-methylpentene-1, polyisoprene, polychloroprene and the like.

Mixtures or blends of these thermoplastic resins and, optionally, thermoplastic elastomers such as polyurethanes and the like, elastomeric polymers such as copolymers of an isoolefin and a conjugated polyolefin, and copolymers of isobutylenes and the like can also be used.

Preferred thermoplastic resins include polyolefins such as polypropylene, linear low density polyethylene, blends of polypropylene and polybutene, and blends of polypropylene and linear low density polyethylene. The polypropylene used by itself or in blends with polybutene (PB) and/or linear low density polyethylene (LLDPE) preferably has a melt flow rate in the range of about 10 to about 80 g/10 min as measured by ASTM D-1238. Blends of polypropylene and polybutene and/or linear low density polyethylene provide self-bonded nonwoven webs with softer hand such that the web has greater flexibility and/or less stiffness.

Additives such as colorants, pigments, dyes, opacifiers such as $TiO_2$, UV stabilizers, fire retardant compositions, processing stabilizers and the like can be incorporated into the polypropylene, thermoplastic resins and blends.

Preferred thermoplastic resins for the uniform basis weight self-bonded webs and for the microfibrous webs include polyolefins such as polypropylene; linear low density polyethylene; blends of polypropylene and polybutene and blends of polypropylene and linear low density polyethylene. The polypropylene used by itself or in blends with polybutene (PB) and/or linear low density polyethylene (LLDPE) preferably has a melt flow rate in the range of about 10 to about 80 g/10 min as measured by ASTM D-1238. Blends of polypropylene and polybutene and/or linear low density polyethylene provide self-bonded nonwoven webs with softer hand such that the web has greater flexibility and/or less stiffness.

The blends of polypropylene and PB can be formulated by metering polybutenes in liquid form into a compounding extruder by any suitable metering device by which the flow rate of the PB into the extruder can be controlled. Polybutene can be obtained in various molecular weight grades with high molecular weight grades typically requiring heating to reduce the viscosity for ease of pumping the polybutene into the extruder. A stabilizer additive package can also be added to the composition blend if desired. Polybutenes suitable for use can have a number average molecular weight ($M_n$) measured by vapor phase osmometry of about 300 to about 3000. The polybutenes can be prepared by well-known techniques such as the Friedel-Crafts polymerization of feedstock comprising isobutylene, or they can be purchased from a number of commercial suppliers such as Amoco Chemical Company, Chicago, Ill., which markets polybutenes under the tradename Indopol®. A preferred number average molecular weight for polybutene is in the range of about 300 to about 2500.

Polybutene can be added directly to polypropylene as described above or can be added via a masterbatch prepared by adding PB to polypropylene at levels of 20 to 25 weight percent in a compounding extruder with the resulting masterbatch blended with polypropylene to achieve a desired level of PB. The weight percent of polybutene that can be added to polypropylene ranges from about 1 to about 15 weight percent or a weight ratio of about 0.1 to about 0.15. Below about 1 weight percent of polybutene added to polypropylene little beneficial effect is shown in the blends and above about 15 weight percent minute amounts of polybutene can migrate to the surface which may detract from the uniform fabric appearance. Preferably polybutene is added to polypropylene in a weight ratio range of about 0.01 to about 0.10.

Blends of polypropylene and LLDPE can be formulated by blending polypropylene resin in the form of pellets or powder with LLDPE in a mixing device such as a drum tumbler and the like. The resin blend of polypropylene and LLDPE with optional stabilizer additive package can be introduced to a polymer melt mixing device such as a compounding extruder of the type typically used to produce polypropylene product in a polypropylene production plant and compounded at temperatures between about 300° F. and about 500° F. Although blends of polypropylene and LLDPE can range from a weight ratio of nearly 1.0 for polypropylene to a weight ratio of nearly 1.0 for LLDPE, typically, the blends of polypropylene and LLDPE useful for making self-bonded webs used in the coated self-bonded nonwoven web composites of the instant invention can have a weight ratio of polypropylene in the range of about 0.99 to about 0.85, preferably in the range of about 0.98 to about 0.92, and a weight ratio of LLDPE in the range of about 0.01 to about 0.15, preferably in the range of about 0.02 to about 0.08. For weight ratios less than 0.01 the softer hand properties imparted from the LDPE are not obtained, and for weight ratios above 0.15 less desirable physical properties and a smaller processing window are obtained.

The linear low density polyethylenes which can be used in making the self-bonded, fibrous nonwoven webs used in making the multi-layer composites of the present invention are random copolymers of ethylene with 1 to 15 weight percent of higher olefin co-monomers such as propylene, n-butene-1, n-hexene-1, n-octene-1 or 4-methylpentene-1, produced over transition metal coordination catalysts. Such linear low density polyethylenes are produced in liquid phase or vapor phase processes. The preferred density of the linear low-density polyethylenes is in the range of about 0.91 to about 0.94 g/cc.

The self-bonded, fibrous nonwoven web used for at least one layer of the multi-layer composite nonwoven web of the present invention can be produced by a system 100, schematically shown in FIG. 1. System 100 includes an extruder 110 which extrudes a fiber forming material such as a thermoplastic polymer melt through feed conduit and adapter 112 to a rotary union 115. A positive displacement melt pump 114 may be located in the feed conduit 112 if the pumping action provided by extruder 110 is not sufficiently accurate for the desired operating conditions. An electrical control can be provided for selecting the rate of extrusion and displacement of the extrudate through the feed conduit 112. Rotary drive shaft 116 is driven by motor 120 at a speed selected by a control means (not shown) and is coupled to rotary die 130. Radial air aspirator 135 is located around rotary die 130 and is connected to air blower 125. Air blower 125, air aspirator 135, rotary die 130, motor 120 and extruder 110 are supported on or attached to frame 105.

In operation, fibers are extruded through and thrown from the rotary die 130 by centrifugal action into a high velocity air stream provided by aspirator 135. The air drag created by the high velocity air causes the fibers to be drawn down from the rotary die 130 and also to be stretched or attenuated. A web forming plate 145 in the shape of an annular ring surrounds the rotary die 130. As rotary die 130 is rotated and fibers 140 extruded, the fibers 140 strike the web forming plate 145. Web forming plate 145 is attached to frame 105 with support arm 148. Fibers 140 are self-bonded during contact with each other and plate 145 thus forming a tubular nonwoven web 150. The tubular nonwoven web 150 is then drawn through the annulus of web forming plate 145 by pull rolls 170 and 165 through nip rolls 160 supported below rotary die 130 which spreads the fabric into a flat two-ply composite 155 which is collected by pull rolls 165 and 170 and may be stored on a roll (not shown) in a standard fashion.

Figure 2:
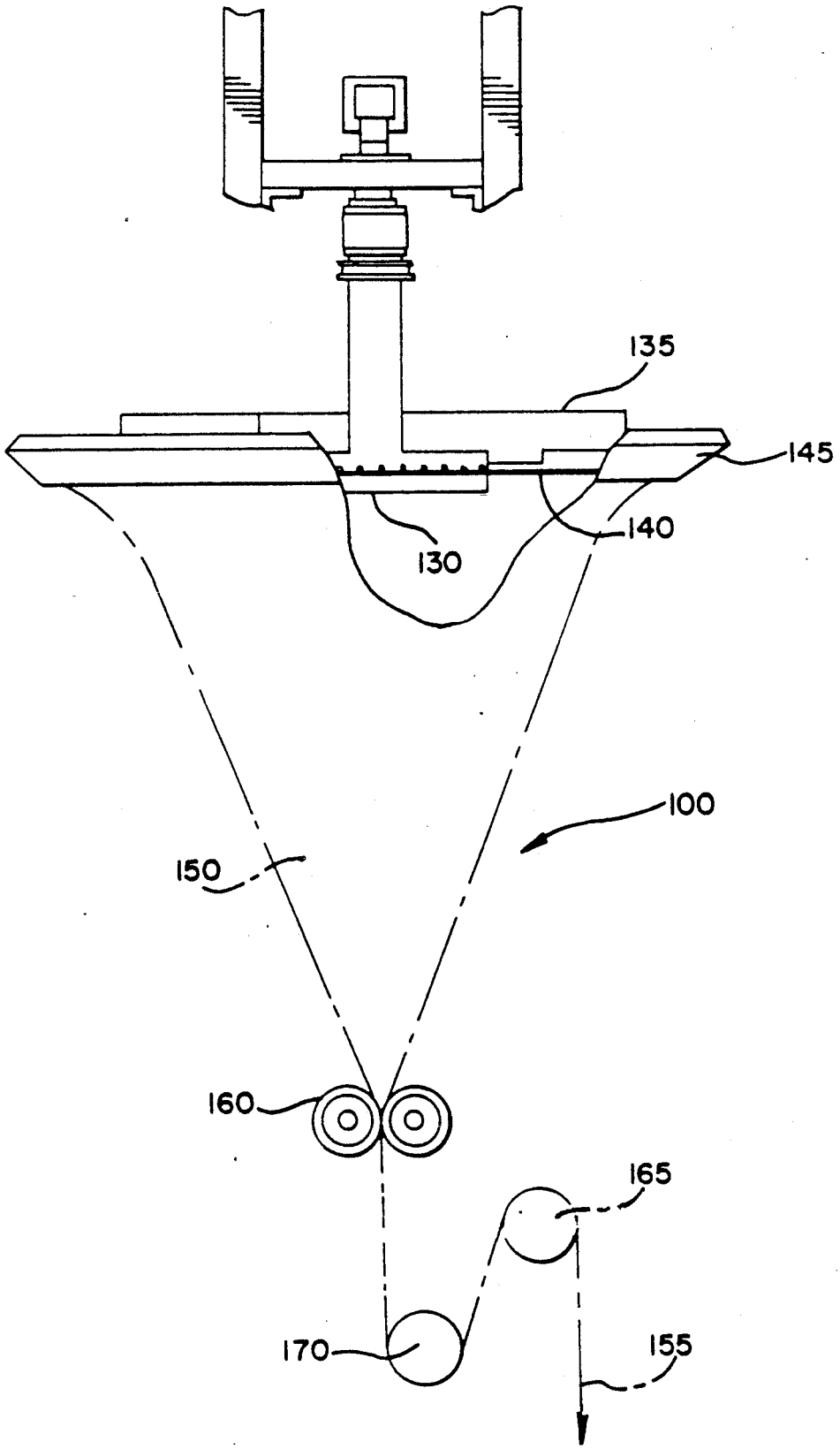
FIG. 2 is a side view of the system of FIG. 1.

FIG. 2 is a side view of system 100 of FIG. 1 schematically showing fibers 140 being extended from rotary die 130, attenuated by the high velocity air from aspirator 135, contacting of fibers 140 on web forming plate 145 to form tubular nonwoven web 150. Tubular nonwoven web 150 is drawn through nip rolls 160 by pull rolls 170 and 165 to form flat two-ply composite 155.

The microfibrous, nonwoven webs which can be used to make the multi-layer composites of the present invention can be meltblown nonwoven webs. Meltblown nonwoven webs can be made by heating a thermoplastic resin to form a polymer melt, extruding the polymer melt through a plurality of fine, typically circular, die capillaries into a high velocity air stream which attenuates the filaments of molten thermoplastic resin to reduce their diameter. For the present invention, filament diameters are in the range of about 1 to about 10 microns, preferably about 1 to about 5 microns. Thereafter, the microfilaments are transported by the high velocity air stream and deposited on a collecting surface to form a web of randomly dispersed, discontinuous meltblown microfibers.

Typically, the meltblown nonwoven webs for the present invention have a basis weight of about 0.1 to about 2.0 oz/yd$^2$, preferably about 0.1 to about 1.0 oz/yd$^2$. For applications which use the multi-layer composites of the present invention utilizing the water repellency and water vapor permeability properties, meltblown layers having basis weights of less than 0.1 oz/yd$^2$ do not contribute sufficient water repellency properties to the composite and meltblown layers having basis weights greater than 2.0 oz/yd$^2$ are too costly and heavy for typical protective apparel applications. Any of the thermoplastic or combination of thermoplastics described above for the self-bonded webs can also be used for the meltblown webs.

The multi-layer composite nonwoven fabrics of the present invention can be produced by bonding at least one layer of a self-bonded web having a plurality of substantially randomly disposed, substantially continuous filaments having a basis weight of about 0.1 oz/yd$^2$ or greater and a BWUI of 1.0 $\pm$0.05 to at least one layer of a nonwoven web comprising discontinuous filaments having a basis weight in the range of about 0.1 to about 2.0 oz/yd$^2$. Typically, the bonding process is a thermal bonding process using heat and pressure to bond the nonwoven webs although any other suitable means for bonding nonwoven polymeric webs together can be employed.

Generally, a calendering operation can be used for the thermal bonding process. The calender can use smooth rollers or a combination of smooth rollers and embossing rollers. The bonding pattern of the embossing rollers can have a regular or intermittent pattern, typically an intermittent pattern is used with the area of composite surface occupied by the bonds ranging from about 5 to 50 percent of the surface area, preferably about 10 to about 25 percent of the surface area has bonds. The bonding can be done as point bonding or stripe bonding with the purpose of the bonding to keep the nonwoven webs from delaminating from the composite while not creating a composite fabric which has too great stiffness.

Depending on the thermoplastics used for the various layers and the desired production rate of the composites of the present invention, calender process parameters such as temperature of the embossing rolls, pressure exerted on the composite by the rolls as well as the speed of the nonwoven webs being fed to the calender may be varied to achieve desired results. The temperature of the calender rollers can range from about 230° to 290° F., the pressure exerted on the composite by the rollers can range from about 250 to 500 psi and the speed of the nonwoven webs fed to the calender can range from about 10 to about 400 feet per minute.

If the calender roll temperatures are too low for the particular multi-layer composite being formed the layers of the resulting composite will tend to delaminate because insufficient bonding of the layers has occurred. However, if the calender roll temperatures are too high the layers of nonwoven webs will fuse to form a film and thereby negate the air permeability properties of the composite.

One particular embodiment of the multi-layer composite nonwoven fabrics of the present invention can be produced with self-bonded, fibrous nonwoven webs produced by the process described above used as outer layers and a meltblown nonwoven web used as an intermediate layer laminated together to form a three-layer composite. The three layers of nonwoven webs are each supplied from rolls to a calender which can have a lower, smooth steel roller and an upper, steel point embossed roller or the rollers can be side-by-side or the embossed roller can be the lower roller. The temperature, pressure and embossing patterns on the embossing roller and speed of the nonwoven webs fed to the calender depend on the thermoplastic material used to produce the self-bonded webs and the meltblown web as well as type of composite desired in terms of stiffness and basis weight.

To obtain a composite with the desired water repellency properties, a meltblown nonwoven web with the desired water repellency properties is selected. In order to provide a fabric of sufficient strength and resistance to abrasion and pilling the composites of the present invention are provided with self-bonded webs to be bonded to the meltblown web to provide strength and protection of the meltblown web. The self-bonded web comprising a plurality of substantially randomly disposed, substantially continuous thermoplastic filaments used as the outer protective layer has a very uniform basis weight with a BWUI of 1.0$\pm$0.05 and is bonded to the inner or intermediate meltblown web comprising a plurality of substantially discontinuous filaments. The uniform basis weight of the self-bonded web allows lesser basis weight self-bonded nonwoven webs to be used as the outer layers and benefits the consumer with a lighter weight and more economical products having water repellency and water vapor permeability properties.

Several advantages are obtained from the multi-layer composites of the present invention with at least one layer of a self-bonded web having a plurality of substantially randomly disposed, substantially continuous thermoplastic filaments bonded to at least one layer of a meltblown web. Among these advantages is the ability to produce lower total basis weight multilayer composites of nonwoven webs with outer layers of a uniform basis weight self-bonded nonwoven web and an intermediate layer of a meltblown nonwoven web which have equivalent or better water repellency and air permeability properties to composites of spunbond/meltblown/spunbond composites having greater total basis weights.

Another advantage is the use of rolls of uniform basis weight self-bonded nonwoven web with rolls of meltblown nonwoven web to produce the desired basis weight and physical property composite web. This enables composites to be produced in which the outer layers of the self-bonded nonwoven web can have different basis weights, have different pigments or different fabric treatments added to the self-bonded webs before producing the desired composite.

Multi-layer composite nonwoven fabrics formed by bonding at least one layer of a uniform basis weight self-bonded nonwoven web to at least one layer of a meltblown nonwoven web and by bonding a layer of uniform basis weight self-bonded nonwoven web to each side of a meltblown nonwoven web have been described. The three-layer composite nonwoven fabric is particularly suited for forming a surgical gown.

Other multi-layer composite nonwoven fabrics can be formed including four-layer composites having two layers of meltblown nonwoven webs as the intermediate layer between two outer layers of uniform basis weight self-bonded, fibrous nonwoven webs. Multiple uniform basis weight self-bonded webs can be combined for outer layers with each self-bonded web having a particular desired color additive and/or fabric treatment.

The invention is described further in the examples appearing below with test procedures used to determine properties reported for the examples as follows:

Tensile and Elongation

Test specimens are used to determine tensile strength and elongation according to ASTM Test Method D-1682. Grab tensile strength can be measured in the MD on 1 inch wide samples of the fabric or in the CD and is reported in units of lbs. A high value is desired for tensile strength.

Elongation can also be measured in the MD or in the CD and is reported in units of %. Lower values are desired for elongation.

Trapezoidal Tear Strength

The trapezoidal tear strength is determined by ASTM Test Method D-1117 and can be measured in the MD or in the CD and is reported in units of lbs with a high value desired.

Fiber Denier

The fiber diameter is determined by comparing a fiber specimen sample to a calibrated reticle under a microscope with suitable magnification. From known polymer densities, the fiber denier is calculated.

Basis Weight

The basis weight for a test sample is determined by ASTM Test Method D 3776 option C.

Basis Weight Uniformity Index

The BWUI is determined for a nonwoven web by cutting a number of unit area and larger area samples from the nonwoven web. The method of cutting can range from the use of scissors to stamping out unit areas of material with a die which will produce a consistently uniform unit area sample of nonwoven web. The shape of the unit area sample can be square, circular, diamond or any other convenient shape. The unit area is 1 $in^2$, and the number of samples is sufficient to give a 0.95 confidence interval for the weight of the samples. Typically, the number of samples can range from about 40 to 80. From the same nonwoven web an equivalent number of larger area samples are cut and weighed. The larger samples are obtained with appropriate equipment with the samples having areas which are N times larger than the unit area samples, where N is about 12 to about 18. The average basis weight is calculated for both the unit area sample and the larger area sample, with the BWUI ratio determined from the average basis weight of the unit area divided by the average basis weight of the larger area. Materials which have unit area and/or area average basis weights determined with standard deviations greater than 10% are not considered to have uniform basis weights as defined herein.

CPAI Hydrostatic Resistance

The hydrostatic resistance of a fabric to water penetration as a column of water is steadily increased in height until the fabric can no longer restrain the water is determined by AATCC Test Method 42. The test result reported is the height in inches reached by the column of water when 3 drops of water penetrate the fabric. A high value is desired.

Impact Penetration Resistance

The impact penetration resistance of a fabric is determined by AATCC Test Method 127 by measuring the amount of water in grams that is absorbed by a standard area of blotter paper when 500 mls of water is showered onto a piece of fabric covering the blotter paper. A low value is desired.

Preparation examples of uniform basis weight self-bonded nonwoven webs from polypropylene, from a blend of polypropylene and polybutene and from a blend of polypropylene and linear low density polyethylene are given below.

SELF-BONDED NONWOVEN POLYPROPYLENE WEB PREPARATION

A polypropylene resin, having a nominal melt flow rate of 35 g/10 min, was extruded at a constant extrusion rate into and through a rotary union, passages of the rotating shaft and manifold system of the die and spinnerets to an annular plate similar to the equipment as shown in FIG. 1 and described above.

The process conditions were:

| | |
|---|---|
| Extrusion conditions | |
| Temperature, °F. | |
| Zone - 1 | 450 |
| Zone - 2 | 500 |
| Zone - 3 | 580 |
| Adapter | 600 |
| Rotary union | 425 |
| Die | 425 |
| Pressure, psi | 200-400 |
| Rotary die conditions | |
| Die rotation, rpm | 2500 |
| Extrudate rate, lb/hr/orifice | 0.63 |
| Air quench conditions | 52 |
| Air quench pressure, in of H2O | |
| Product physical characteristics | |
| CPAI hydrostatic resistance, inches | 6.0 |
| Impact penetration resistance, grams | 23.3 |
| Thickness, mils | |
| Samples, number | 60 |
| Average thickness | 11.04 |
| Coefficient of variation | 1.50075 |
| Standard deviation | 1.22505 |
| Range | 6 |
| Basis Weight | |
| Samples, number | 60 |
| Test specimen, type | 1-in square |
| Weight, g | |
| Average | 0.02122 |
| Coefficient of variation | $1.9578 \times 10^{-6}$ |
| Standard deviation | $1.3992 \times 10^{-3}$ |
| Range | $5.3 \times 10^{-3}$ |
| Basis weight, oz/$yd^2$ | 0.9692 |
| Samples, number | 60 |
| Test specimen, type | 4-in square |
| Weight, g | |
| Average | 0.3370 |
| Coefficient of variation | $2.6348 \times 10^{-4}$ |
| Standard deviation | $1.6232 \times 10^{-2}$ |

-continued

| | |
|---|---|
| Range | 0.068 |
| Basis weight, oz/yd$^2$ | 0.9620 |
| BWUI | 1.0075 |

SELF-BONDED NONWOVEN WEB PREPARATION FROM A BLEND OF POLYPROPYLENE AND POLYBUTENE

A blend of 93 wt. % of a polypropylene having a nominal melt flow rate of 38 g/10 min and 7 wt. % of polybutene having a nominal number average molecular weight of 1290 was melt blended in a Werner & Pfleiderer ZSK-57 twin-screw extruder and Luwa gear pump finishing line. The resulting product was extruded at a constant extrusion rate into and through a rotary union, passages of the rotating shaft and manifold system of the die and spinnerets to an annular plate in the equipment as shown in FIG. 1 and described above.

| | |
|---|---|
| Extrusion conditions | |
| Temperature, °F. | |
| Zone - 1 | 435 |
| Zone - 2 | 450 |
| Zone - 3 | 570 |
| Adapter | 570 |
| Rotary union | 550 |
| Die | 450 |
| Screw rotation, rpm | 50 |
| Pressure, psi | 800 |
| Rotary die conditions | |
| Die rotation, rpm | 2100 |
| Extrudate rate, lb/hr/orifice | 0.78 |
| Product physical characteristics | |
| Filament Denier (average) | 3–4 |
| Basis weight, oz/yd$^2$ | 1.25 |
| Grab tensile | |
| MD, lbs | 13.4 |
| CD, lbs | 9.0 |
| Elongation | |
| MD, % | 150 |
| CD, % | 320 |
| Trap tear | |
| MD, lbs | 7.5 |
| CD, lbs | 5.8 |

SELF-BONDED NONWOVEN WEB PREPARATION FROM A BLEND OF POLYPROPYLENE AND LINEAR LOW-DENSITY POLYETHYLENE

A blend of 95 wt. % of a polypropylene having a nominal melt flow rate of 38 g/10 min and 5 wt. % of a linear low-density polyethylene having a nominal density of 0.94 g/cc was melt blended in a 2.5 inch Davis Standard single-screw extruder. The resulting product was extruded at a constant extrusion rate into and through a rotary union, passages of the rotating shaft and manifold system of the die and spinnerets to an annular plate in the equipment as shown in FIG. 1 and described above.

The process conditions were:

| | |
|---|---|
| Extrusion conditions | |
| Temperature, °F. | |
| Zone - 1 | 490 |
| Zone - 2 | 540 |
| Zone - 3 | 605 |
| Adapter | 605 |

-continued

| | |
|---|---|
| Rotary union | 550 |
| Die | 450 |
| Screw rotation, rpm | 40 |
| Pressure, psi | 1000 |
| Rotary die conditions | |
| Die rotation, rpm | 2100 |
| Extrudate rate, lb/hr/orifice | 0.65 |
| Air quench conditions | 55 |
| Air quench pressure, in of H2O | |
| Product physical characteristics | 0.25 |
| Basis weight, oz/yd$^2$ | |

The following examples further elaborate the present invention, although it will be understood that these examples are for purposes of illustration, and are not intended to limit the scope of the invention.

EXAMPLE 1

Three-layer composite nonwoven fabrics were made utilizing two layers of a uniform basis weight self-bonded nonwoven web for the outer layers and a meltblown microfibrous fabric as the intermediate layer. The self-bonded nonwoven web was prepared as described above from a polypropylene having a nominal melt flow rate of 35 g/10 min and had a basis weight of 0.25 oz/yd$^2$ with the web wound onto a roll. The microfibrous fabric was a meltblown nonwoven from Ergon made of polypropylene wound onto a roll and had basis weights of 0.35, 0.39, 0.50 and 0.58 oz/yd$^2$, respectively. Two rolls of the 0.25 oz/yd$^2$ basis weight self-bonded nonwoven web used as the outer layers and a roll of the meltblown fabric used as the intermediate layer were fed uniformly through a 22 inch wide calender with an upper, hard steel, embossed calender roll temperature maintained at 260° F. and a lower, hard steel, smooth calender roll temperature maintained at 260° F. The bonding area of the embossing upper roll was 16 percent of the total surface area of the composite. A pressure of 300 psi was maintained on the three layers of fabric to heat bond the layers to form a three-layer composite nonwoven fabric at a speed of 25 feet per minute (fpm). The hydrostatic resistance as determined by AATCC Test Method 127 and the water impact penetration as determined by AATCC Test Method 42 were measured for the composites and are given in Table I below.

For the three-layer composite with total basis weight of 1.0 oz/yd$^2$ grab tensile strength and trapezoid tear strength were determined and are given in Table II below.

TABLE I

| Basis Weight, oz/yd$^2$ | | | |
|---|---|---|---|
| Total | Intermediate Layer | Water Impact Penetration, grams | Hydrostatic Resistance, inches |
| 0.85 | 0.35 | 24.5 | 11.1 |
| 0.90 | 0.39 | 13.8 | 18.1 |
| 1.0 | 0.50 | 1.2 | 18.5 |
| 1.1 | 0.58 | .3 | 18.0 |

TABLE II

| Product physical characteristics | |
|---|---|
| Basis weight, oz/yd$^2$ | 1.0 |
| Grab tensile | |
| MD, g | 6170 |
| CD, g | 4395 |
| Elongation | |
| MD, % | 34 |

TABLE II-continued

| Product physical characteristics | |
|---|---|
| CD, % | 74 |
| Trap tear | |
| MD, lbs | 5.1 |
| CD, lbs | 4.2 |

EXAMPLE 2

Three-layer composites using uniform basis weight self-bonded, nonwoven webs made of polypropylene having a melt flow rate of 35 g/10 min with a basis weight of 0.25 oz/yd$^2$ as outer layers on each side of a meltblown, nonwoven web as the intermediate layer with the melt-blown layer made of polypropylene and having basis weights given in Table III. Physical property values of impact penetration and hydrostatic resistance were determined for the various total basis weight three-layer composites and are given in Table III.

Table III

| Basis Weight, oz/yd$^2$ | | | |
|---|---|---|---|
| Total | Meltblown Layer | Water Impact Penetration, grams | Hydrostatic Resistance, inches |
| 0.70 | 0.20 | 18.3 | 9.25 |
| 0.74 | 0.24 | 8.0 | 11.3 |
| 0.80 | 0.30 | 2.7 | 16.0 |
| 0.85 | 0.35 | 1.4 | 25.0 |

EXAMPLE 3

Three-layer composite nonwoven fabrics were made according to the procedure given in Example 1. The outer two layers utilized a uniform basis weight self-bonded nonwoven web produced from a blend of polypropylene and polybutene with a weight ratio of 0.93 for a polypropylene with a nominal melt flow rate of 35 g/10 min and a weight ratio of 0.07 for a polybutene having a nominal number average molecular weight of about 1290 to form composites having basis weights in the range of 0.7 oz/yd$^2$ and greater were produced. Meltblown polypropylene fabrics from Ergon having basis weights of 0.4 to 0.6 oz/yd$^2$ were used. The two fabrics were calendered with a calender embossing roll temperature and a calender smooth roll temperature in the range of 160° to 240° F. with pressures in the range of 200 to 350 psi at speeds up to 30 fpm. The resulting composites having basis weights in the range of 0.7 to 1.1 oz/yd$^2$ were qualitatively determined to have a softer hand than composites made from 100 percent polypropylene.

EXAMPLE 4

Three layer composite nonwoven fabrics were made according to the procedure given in Example 1. The outer two layers utilized a uniform basis weight self-bonded nonwoven web produced from blends of polypropylene having a nominal melt flow rate of 35 g/10 min and various weight ratios of a nominal 20 melt index LLDPE at weight ratios of 0.025, 0.05, 0.075, 0.1 and 0.125 for the LLDPE. Meltblown polypropylene fabrics having basis weights ranging from 0.2 to 0.7 oz/yd$^2$ were used. The two fabrics were calendered with a calender embossing roll temperature and a smooth roll temperature in the range of 160° to 240° F., a pressure exerted on the composites by the calender rolls in the range of 200 to 550 psi and at speeds up to 40 fpm. The resulting composites were qualitatively determined to have a softer hand than composites made from 100 percent polypropylene. Among the composites containing LLDPE the composite with the outer layers of self-bonded nonwoven web containing a blend of polypropylene with a weight ratio of 0.05 LLDPE was determined qualitatively to have the softest hand.

COMPARATIVE EXAMPLES

The physical properties for meltblown polypropylene nonwoven fabrics and self-bonded nonwoven fabrics used as layers for the composites of the present invention are given below in Table IV.

TABLE IV

| Product Type | Self-bonded | Self-bonded | Meltblown | Meltblown |
|---|---|---|---|---|
| Material Condition | Polypropylene Calendered | Polypropylene Calendered | Polypropylene Calendered | Polypropylene Uncalendered |
| Basis weight, oz/yd$^2$ | 0.2 | 0.5 | 0.44 | 0.44 |
| Grab tensile, | | | | |
| MD, g | 1600 | 3740 | 1500 | 1970 |
| CD, g | 820 | 2600 | 2170 | 1610 |
| MD Grab tensile per basis weight, g/oz/yd$^2$ | 7980 | 7470 | 3400 | 4490 |
| Elongation, | | | | |
| MD, % | 20 | 38 | 34 | 26 |
| CD, % | 30 | 75 | 25 | 34 |
| Trapezoidal tear, | | | | |
| MD, lbs | 1.2 | 3.2 | 0.4 | 0.4 |
| CD, lbs | 0.7 | 2.3 | 0.6 | 0.3 |

COMPARATIVE SMS EXAMPLES

Samples of spunbond/meltblown/spunbond were obtained from 10 surgical gowns manufactured by Kimberly-Clark Corporation. Basis weight, water impact penetration and hydrostatic resistance were measured for these samples. The results of these tests as well as grab tensile and trapezoidal tear strength are given in Table V below.

TABLE V

| | |
|---|---|
| Basis weight, oz/yd$^2$ | |
| Average of 45 samples | 0.99 |
| Range | 0.89-1.1 |
| Water Impact Penetration, grams | |
| Average of 45 samples | 13.1 |
| Range | 3.7-23.2 |
| Hydrostatic Resistance, inches | |
| Average of 40 samples | 12.6 |
| Range | 5.3-18 |
| Product physical characteristics | |

TABLE V-continued

| | |
|---|---|
| Basis weight, oz/yd$^2$ | 1.0 |
| Grab tensile | |
| MD, g | 6000 |
| CD, g | 4900 |
| Elongation | |
| MD, % | 29 |
| CD, % | 39 |
| Trapezoidal tear | |
| MD, lbs | 4.5 |
| CD, lbs | 3.5 |

A nominal 1.0 oz/yd uniform basis weight self-bonded polypropylene nonwoven web was prepared by the method described above and filament denier, basis weights for 1 in×1 in square and 4 in×4 in square samples, cross machine direction and machine direction tensile strengths were determined for this self-bonded nonwoven web as well as for nominal 1.0 oz/yd$^2$ basis weight spunbond materials such as Kimberly-Clark's Accord (Comparative A), James River's Celestra (Comparative B) and Wayn-Tex's Elite (Comparative C). These properties are summarized in Tables VI-X below.

TABLE VI

NONWOVEN WEB PROPERTIES
Basis Weight - 4 in × 4 in Square Samples

| Property | Self-bonded Nonwoven Web | Comparative A | Comparative B | Comparative C |
|---|---|---|---|---|
| Number of Samples | 60 | 60 | 60 | 18 |
| Sample Area, in$^2$ | 16 | 16 | 16 | 16 |
| Basis Weight, oz/yd$^2$ | | | | |
| Average | 0.968667 | 0.998833 | 1.01317 | 0.967778 |
| Median | 0.97 | 1.01 | 1.00 | 0.98 |
| Variance | $2.43887 \times 10^{-3}$ | $7.09523 \times 10^{-3}$ | $6.84234 \times 10^{-3}$ | $1.42418 \times 10^{-2}$ |
| Minimum | 0.86 | 0.8 | 0.82 | 0.78 |
| Maximum | 1.07 | 1.21 | 1.2 | 1.21 |
| Range | 0.21 | 0.41 | 0.38 | 0.43 |
| Standard Deviation (SD) | 0.0493849 | 0.0842332 | 0.0827185 | 0.119339 |
| SD, % of Average | 5.10 | 8.43 | 8.16 | 12.33 |

TABLE VII

NONWOVEN WEB PROPERTIES
Basis Weight - 1 in × 1 in Square Samples

| Property | Self-bonded Nonwoven Web | Comparative A | Comparative B | Comparative C |
|---|---|---|---|---|
| Number of Samples | 60 | 60 | 60 | 60 |
| Sample Area, in$^2$ | 1 | 1 | 1 | 1 |
| Basis Weight, oz/yd$^2$ | | | | |
| Average | 0.993667 | 0.9665 | 0.9835 | 0.945167 |
| Median | 0.99 | 0.965 | 0.97 | 0.97 |
| Variance | $4.50836 \times 10^{-3}$ | 0.0186774 | 0.0245214 | 0.0251847 |
| Minimum | 0.88 | 0.69 | 0.69 | 0.62 |
| Maximum | 1.17 | 1.26 | 1.32 | 1.34 |
| Range | 0.29 | 0.57 | 0.63 | 0.72 |
| Standard Deviation (SD) | 0.0671443 | 0.136665 | 0.156593 | 0.158697 |
| SD, % of Average | 6.76 | 14.14 | 15.92 | 16.79 |
| BWUI | 1.026 | 0.968* | 0.971* | 0.977* |

*SD 10% of average for one or both basis weights.

TABLE VIII

NONWOVEN WEBB PROPERTIES
Filament Denier

| Property | Self-bonded Nonwoven Web | Comparative A | Comparative B | Comparative C |
|---|---|---|---|---|
| Number of Samples | 100 | 100 | 100 | 100 |
| Denier | | | | |
| Average | 2.254 | 2.307 | 3.962 | 5.295 |
| Median | 1.7 | 2.2 | 4.2 | 5.8 |
| Variance | 1.22473 | 0.206718 | 0.326622 | 0.82048 |
| Minimum | 0.9 | 1.2 | 2.8 | 2.2 |
| Maximum | 5.8 | 4.2 | 5.8 | 7.7 |
| Range | 4.9 | 3 | 3 | 5.5 |
| Standard Deviation (SD) | 1.10668 | 0.454663 | 0.571509 | 0.905803 |
| SD, % of Average | 49.10 | 19.71 | 14.42 | 17.11 |

TABLE IX

NONWOVEN WEBB PROPERTIES
Cross Machine Direction Tensile Strength

| Property | Self-bonded Nonwoven Web | Comparative A | Comparative B | Comparative C |
|---|---|---|---|---|
| Number of Samples | 30 | 30 | 30 | 18 |

TABLE IX-continued

| Property | NONWOVEN WEBB PROPERTIES Cross Machine Direction Tensile Strength Self-bonded Nonwoven Web | Comparative A | Comparative B | Comparative C |
|---|---|---|---|---|
| Tensile Strength, lb | | | | |
| Average | 4.60217 | 9.14053 | 2.94907 | 4.00072 |
| Median | 4.694 | 9.035 | 2.772 | 3.9435 |
| Variance | 0.19254 | 2.09982 | 0.271355 | 1.71677 |
| Minimum | 3.742 | 5.318 | 2.166 | 1.399 |
| Maximum | 5.374 | 11.56 | 4.443 | 6.15 |
| Range | 1.632 | 6.242 | 2.277 | 4.751 |
| Standard Deviation (SD) | 0.438794 | 1.44908 | 0.520918 | 1.31025 |
| SD, % of Average | 9.53 | 15.85 | 17.66 | 32.75 |

TABLE X

| Property | NONWOVEN WEBB PROPERTIES Machine Direction Tensile Strenght Self-bonded Nonwoven Web | Comparative A | Comparative B | Comparative C |
|---|---|---|---|---|
| Number of Samples | 30 | 30 | 30 | 18 |
| Tensile Strenght, lb | | | | |
| Average | 4.7511 | 5.51813 | 8.56907 | 6.93222 |
| Median | 4.7675 | 5.4755 | 8.7675 | 6.4725 |
| Variance | 0.0789548 | 0.686962 | 1.22762 | 5.84547 |
| Minimum | 4.15 | 3.71 | 6.489 | 3.436 |
| Maximum | 5.251 | 7.04 | 10.21 | 12.16 |
| Range | 1.101 | 3.33 | 3.721 | 8.724 |
| Standard Deviation (SD) | 0.280989 | 0.828832 | 1.10798 | 2.41774 |
| SD, % of Average | 5.91 | 15.02 | 12.93 | 34.88 |

That which is claimed is:

1. A multi-layer composite nonwoven fabric having a basis weight in the range of about 0.5 to about 5.0 oz/yd$^2$ with water repellency and water vapor permeability properties comprising, at least one layer of a uniform basis weight self-bonded web comprising a plurality of substantially randomly disposed, substantially continuous thermoplastic filaments wherein said web has a basis weight of about 0.1 oz/yd$^2$ or greater and a BWUI of 1.0±0.05 determined from average basis weights having standard deviations of less than 10%, and at least one layer of a microfibrous web comprising a plurality of substantially totally discontinuous thermoplastic microfibers.

2. The fabric of claim 1 wherein said thermoplastic filaments and said thermoplastic microfibers comprise thermoplastics selected from the group consisting of polypropylene, high-density polyethylene, low density polyethylene, linear low density polyethylene, a blend of polypropylene and polybutene and a blend of linear low density polyethylene and polypropylene.

3. The fabric of claim 1 wherein said thermoplastic filaments and said thermoplastic microfibers comprise polypropylene.

4. The fabric of claim 1 wherein said thermoplastic filaments comprise a blend of polybutene and polypropylene and said thermoplastic microfibers comprise polypropylene.

5. The fabric of claim 4 wherein said blend of polybutene and polypropylene has a weight ratio in the range of about 0.01 to about 0.15 of a polybutene having a number average molecular weight in the range of about 300 to about 2,500 and a weight ratio in the range of about 0.99 to about 0.85 of a polypropylene having a melt flow rate in the range of about 10 to about 80 g/10 min as measured by ASTM D-1238.

6. The fabric of claim 5 wherein said blend of polybutene and polypropylene has a weight ratio in the range of about 0.01 to about 0.10 of the polybutene.

7. The fabric of claim 1 wherein said thermoplastic filaments comprise a blend of linear low density polyethylene and polypropylene and said thermoplastic microfibers comprise polypropylene.

8. The fabric of claim 7 wherein said blend of linear low density polyethylene and polypropylene has a weight ratio in the range of about 0.01 to about 0.15 of a linear low density polyethylene having a density of about 0.91 to about 0.94 g/cc and a weight ratio in the range of about 0.98 to about 0.85 of a polypropylene having a melt flow rate in the range of about 10 to about 80 g/10 min as measured by ASTM D-1238.

9. The fabric of claim 8 wherein said blend of linear low density polyethylene and polypropylene has a weight ratio in the range of about 0.02 to about 0.08 of the linear low density polyethylene.

10. A multi-layer composite nonwoven fabric having a basis weight in the range of about 0.7 to about 1.5 oz/yd$^2$ with water repellency and water vapor permeability properties comprising, two layers of a uniform basis weight self-bonded web wherein each layer has a basis weight in the range of about 0.15 to about 1.0 oz/yd$^2$ and a BWUI of 1.0±0.05 determined from average basis weights having standard deviations of less than 10% and said web comprises a plurality of substantially randomly disposed, substantially continuous thermoplastic filaments wherein said filaments have deniers in the range of about 0.5 to about 20 and comprise thermoplastics selected from the group consisting of polypropylene, a blend of polybutene and polypropylene and a blend of linear low density polyethylene and polypropylene, and a layer of a microfibrous web comprising a plurality of substantially totally discontinuous thermoplastic microfibers having a basis weight in the range of about 0.1 to about 1.0 oz/yd$^2$.

11. The fabric of claim 10 wherein said thermoplastic filaments and said thermoplastic microfibers comprise polypropylene.

12. The fabric of claim 10 wherein said thermoplastic filaments comprise a blend of polybutene and polypropylene and said thermoplastic microfibers comprise polypropylene.

13. The fabric of claim 10 wherein said blend of polybutene and polypropylene has a weight ratio in the range of about 0.01 to about 0.15 of a polybutene having a number average molecular weight in the range of about 300 to about 2,500 and a weight ratio in the range of about 0.99 to about 0.85 of a polypropylene having a melt flow rate in the range of about 10 to about 80 g/10 min as measured by ASTM D-1238.

14. The fabric of claim 13 wherein said blend of polybutene and polypropylene has a weight ratio in the range of about 0.01 to about 0.10 of the polybutene.

15. The fabric of claim 10 wherein said thermoplastic filaments comprise a blend of linear low density polyethylene and polypropylene and said thermoplastic microfibers comprise polypropylene.

16. The fabric of claim 10 wherein said blend of linear low density polyethylene and polypropylene has a weight ratio in the range of about 0.01 to about 0.15 of a linear low density polyethylene having a density of about 0.91 to about 0.94 g/cc and a weight ratio in the range of about 0.98 to about 0.85 of a polypropylene having a melt flow rate in the range of about 10 to about 80 g/10 min as measured by ASTM D-1238.

17. The fabric of claim 16 wherein said blend of linear low density polyethylene and polypropylene has a weight ratio in the range of about 0.02 to about 0.08 of the linear low density polyethylene.

18. The fabric of claim 1 wherein said self-bonded web layer has a grab tensile strength per basis weight of 7,000 g/oz/yd$^2$ or greater.

19. The fabric of claim 10 in the form of a protective gown.

20. The fabric of claim 1 wherein said filaments of said self-bonded web have deniers in the range of about 0.5 to 20.

21. The fabric of claim 1 wherein said microfibrous web has a basis weight in the range of about 0.1 to about 2.0 oz/yd$^2$.

* * * * *